US011613452B2

(12) United States Patent
Mailhot et al.

(10) Patent No.: US 11,613,452 B2
(45) Date of Patent: Mar. 28, 2023

(54) ARM RESTRAINTS FOR VEHICLE LIFT AND VEHICLE LIFT INCLUDING THE SAME

(71) Applicant: CANADA HYDRAULIQUE EQUIPEMENT INC., Saint-Jacques (CA)

(72) Inventors: Luc Mailhot, St-Liguori (CA); Normand Mitchell, Notre-Dame-des-Prairies (CA); Stéphane Jean, St-Ambroise de Kildare (CA)

(73) Assignee: CANADA HYDRAULIQUE EQUIPEMENT INC., Saint-Jacques (CA)

( * ) Notice: Subject to any disclaimer, the term of this patent is extended or adjusted under 35 U.S.C. 154(b) by 580 days.

(21) Appl. No.: 16/705,481

(22) Filed: Dec. 6, 2019

(65) Prior Publication Data

US 2021/0171327 A1 Jun. 10, 2021

(51) Int. Cl.
*B66F 7/28* (2006.01)
*B66F 7/02* (2006.01)

(52) U.S. Cl.
CPC ..... *B66F 7/28* (2013.01); *B66F 7/02* (2013.01); *B66F 2700/025* (2013.01)

(58) Field of Classification Search
CPC ..... B66F 2700/025
USPC ..... 269/17
See application file for complete search history.

(56) References Cited

U.S. PATENT DOCUMENTS 4,212,449 A 7/1980 Tsujimura
4,715,477 A * 12/1987 Suzuki ..... B66F 7/02 187/210
9,840,402 B2 * 12/2017 Horimizu ..... B60S 9/04

FOREIGN PATENT DOCUMENTS

DE 2742518 A1 * 9/1977
DE 2742518 3/1979
DE 8225701 4/1983
GB 2044216 10/1980
(Continued)

OTHER PUBLICATIONS

Canadian Intellectual Property Office, Examination Report dated Jan. 28, 2021, issued in Canadian Patent Application No. 3,064,238.

*Primary Examiner* — Don M Anderson
*Assistant Examiner* — Jonathan R Zaworski
(74) *Attorney, Agent, or Firm* — Gottlieb, Rackman & Reisman

(57) ABSTRACT

The present disclosure relates to a vehicle lift which is equipped with a safety assembly preventing a load-carrier arm to pivot once the vehicle is being lifted. The vehicle lift includes a lifting post which has a base, an upward post extending from the base, a carriage which is slidably and operatively mounted to the post structure, as well as a pivotable load-carrier arm pivotally mounted to the carriage for providing a support to the vehicle being lifted. Pivot of the arm provides positioning and adjustment beneath the vehicle. The vehicle lift further includes an arm restraint coupled to the load-carrier arm. The arm restraint is configured to operate between a released configuration, where a portion of the arm restraint engages with the base, thereby allowing the load-carrier arm to pivot, and a locked configuration, where the arm restraint is positioned above the base, thereby preventing the load-carrier arm from pivoting.

20 Claims, 11 Drawing Sheets

(56) References Cited

FOREIGN PATENT DOCUMENTS

| | | | | |
|---|---|---|---|---|
| GB | 2044216 A | * | 10/1980 | ..... B66F 7/025 |
| GB | 2049618 | | 12/1980 | |

* cited by examiner

ARM RESTRAINTS FOR VEHICLE LIFT AND VEHICLE LIFT INCLUDING THE SAME

TECHNICAL FIELD

The present disclosure relates to vehicle lifts or hoists for use in lifting cars and/or trucks for service to the tires, wheels, brake systems, suspension systems and the like. More particularly, the present disclosure relates to safety mechanisms for such vehicle lifts.

BACKGROUND

Vehicle lifts can be defined as machines, usually as hydraulic machines, by which vehicles, such as cars or trucks, are lifted above the ground surface to give access to the underparts of the vehicle. A vehicle lift usually includes spaced apart hydraulic hoist post(s) positioned such as to allow a vehicle to be introduced or displaced therebetween. Each hoist post can include a vertical post structure, a carriage which is movable up and down along the post structure between the ground surface and a hoisted level, as well as one or more load-carrier arm(s) pivotally coupled to the carriage. For example, the vehicle lift can include two hydraulic hoist posts, where each post includes two load-carrier arms so that the arms together define a four-point support for the vehicle to be lifted.

While it is necessary for the arms to pivot about a vertical axis for example in order to provide adjustment to reach the vehicle lifting points on different vehicle configurations, shapes and/or sizes that are to be lifted, it is important to prevent the arms from pivoting while the vehicle is being lifted (i.e., while the carriage is sliding along the post structure away from the ground surface). Indeed, the arms can have a tendency to slip when the support points on the vehicle are damages, uneven or dirty.

Even though some safety mechanisms are provided to prevent the load-carrier arms of a vehicle lift from pivoting once the carriage is sliding away from the ground surface, none of the constructions so far proposed is wholly satisfactory.

In view of the above, there is therefore a need for a safety mechanism that prevents a load-carrier arm from pivoting once the carriage is lifting away from the ground surface and which, by virtue of its design and components, would be able to overcome or at least minimize some of the above-discussed concerns.

SUMMARY

It is an object of the present disclosure to provide an arm restraint for a vehicle lift and a vehicle lift which includes the same that overcome or mitigate one or more disadvantages of known safety mechanisms preventing a load-carrier arm from pivoting or of known vehicle lifts, or at least provide useful alternatives.

In accordance with an embodiment, there is provided a lift for lifting a heavy load above a floor, the lift comprising: a lifting post extending upwardly from the floor; a carriage mounted to the lifting post and vertically displaceable therealong; a load-carrier arm pivotally mounted to the carriage and vertically displaceable along the lifting post with the carriage; and an arm restraint mounted to the load-carrier arm and vertically displaceable along the lifting post with the carriage and the load-carrier arm, the arm restraint being configurable in a released configuration wherein the load-carrier arm is pivotable with respect to the lifting post and a locked configuration, wherein pivoting of the load-carrier arm with respect to the lifting post is prevented, the arm restraint comprising a main bracket mounted to the carriage and having a bracket locking surface and a locking rod mounted to the load-carrier arm and having a rod locking surface, with the locking surfaces of the main bracket and the locking rod being engaged together in the locked configuration to prevent relative displacement of the main bracket and the locking rod and being disengaged from one another in the released configuration to allow relative displacement of the main bracket and the locking rod.

In some implementations, the arm restrain further comprises a locking assembly having a bracket portion provided on the main bracket and a rod portion provided on the locking rod, each one of the bracket and rod portions comprises respectively the bracket and rod locking surfaces, with at least one of the locking surfaces of the bracket and rod portions being biased towards the other one of the locking surfaces in the locked configuration.

In some implementations, the main bracket defines a bracket locking end and a bracket pivoting end opposite the bracket locking end, the bracket pivoting end being pivotally mounted to the carriage and pivotable about a bracket pivot axis.

In some implementations, the locking rod defines a rod pivoting end and a rod free end opposite the rod pivoting end, the rod pivoting end being pivotally mounted to the load-carrier arm so as to pivot about a rod pivot axis.

In some implementations, the bracket portion of the locking assembly comprises a guide portion protruding from the main bracket and adjacent to the bracket locking end, the guide portion defining a rod-receiving channel extending substantially parallel to the main bracket with the locking rod being inserted therein, the locking rod being translatable in the rod-receiving channel in the released configuration of the arm restraint.

In some implementations, the bracket portion of the locking assembly further comprises a locking element including the bracket locking surface and a biasing device operatively engaged with the locking element and biasing the bracket locking surface of the locking element towards the rod locking surface in the locked configuration of the arm-restraint.

In some implementations, the guide portion defines a lock-receiving cavity in which the locking element is received and a section of the locking rod extends.

In some implementations, the lifting post comprises a base supporting the lifting post on the floor and the main bracket comprises a lever abutting at least one of the floor and the base in at least a lowest configuration of the load-carrier arm to configure the arm restraint in the released configuration.

In some implementations, the locking assembly further comprises a lock transmission assembly operatively coupling the locking element to the lever so as to allow the displacement of the locking element between an engaged configuration and a disengaged configuration in accordance with a configuration of the lever with the locking element being configured in the disengaged configuration when the lever is abutting at least one of the floor and the base.

In some implementations, the lock transmission assembly comprises: a transmission link extending between a first end and a second end, the first end being operatively coupled to the lever; a locking portion connector coupled to the locking element and translating therewith between the engaged and disengaged configurations; an articulated connection connecting the locking portion connector to the transmission link; and the biasing device operatively connected to the locking portion connector for biasing the locking element into the engaged configuration when the lever is substantially free of external pressure applied thereon.

In some implementations, the lever defines a base-engageable end and a bracket-connecting end, opposite the base-engageable end, the bracket-connecting end being pivotally mounted to the main bracket and pivotable about a lever pivot axis.

In some implementations, the first end of the transmission link is pivotally mounted to the bracket-connecting end at a lever connection point spaced apart from the lever pivot axis.

In some implementations, the main bracket further comprises an articulation plate support extending downwardly from a lower surface of the main bracket and the articulated connection comprises: an articulation plate defining a first articulation axis, a second articulation axis and a third articulation axis, the second end of the transmission link being pivotally coupled to the articulation plate at the first articulation axis, the articulation plate being pivotally mounted and coupled to the articulation plate support and pivotable about the second articulation axis; and a connector link extending between a first link end and a second link end, the first link end being pivotally mounted and coupled to the articulation plate at the third articulation axis, the second link end being pivotally mounted and coupled to a lower end of the locking portion connector of the lock transmission assembly.

In some implementations, the biasing device extends between the main bracket and the locking element when the lever is substantially free of external pressure applied thereon, the locking element is pushed towards the locking rod for engagement of the locking surfaces.

In some implementations, the biasing device is a coiled spring surrounding a section of the locking portion connector.

In some implementations, the locking portion connector extends through the main bracket into a connector channel extending therethrough and adjacent to the bracket locking end, the locking portion connector being translatably inserted in the connector channel with sections of the locking portion connector extending outwardly of the main bracket at both ends, the locking element being mounted to an upper end of the locking portion connector.

In some implementations, a diameter of the connector channel is larger adjacent to the locking element to define a biasing device-receiving recess with a portion of the biasing device being contained in the biasing device-receiving recess.

In some implementations, the main bracket defines a longitudinally-extending segment and a bracket pivoting segment extending upwardly from the longitudinally-extending segment, wherein a distal end of the bracket pivoting segment is pivotally mounted to the carriage and pivotable about the bracket pivot axis.

In some implementations, the carriage comprises: more than one of the load-carrier arm and the arm restraint, each one of the load-carrier arms being independently pivotally mounted to the carriage and vertically displaceable along the lifting post with the carriage; and each one of the arm restraints is being mounted to a corresponding one of the plurality of load-carrier arms and being vertically displaceable along the lifting post with the carriage and the corresponding one of the plurality of load-carrier arms.

In accordance with another embodiment, there is provided an arm restraint in combination with an heavy load lift, the heavy load lift comprising a lifting post including a post structure extending upwardly, a carriage slidably mounted to the post structure, and a pivotable load carrier arm mounted to the carriage and vertically displaceable therewith along the post structure, the arm restraint comprising: a main bracket mounted to the carriage and vertically displaceable therewith along the post structure, the main bracket having a bracket locking surface; and a locking rod mounted to the load-carrier arm and having a rod locking surface, the bracket locking surface and the rod locking surface being automatically disengaged from one another when the carriage is positioned in an arm restraint-disengaged section of the post structure, thereby allowing relative displacement of the main bracket and the locking rod and pivoting of the load-carrier arm; and the bracket locking surface and the rod locking surface being automatically engaged together when the carriage is located outside the arm restraint-disengaged section, thereby preventing relative displacement of the main bracket and the locking rod and pivoting of the load-carrier arm.

In some implementations, the arm restraint further comprises a locking assembly having a bracket portion provided on the main bracket and a rod portion provided on the locking rod, each one of the bracket and rod portions comprises respectively the bracket and rod locking surfaces, with at least one of the locking surfaces of the bracket and rod portions being biased towards the other one of the locking surfaces when the carriage is located outside the arm restraint-disengaged section.

In some implementations, the main bracket defines a bracket locking end and a bracket pivoting end opposite the bracket locking end, the bracket pivoting end being pivotally mounted to the carriage so as to pivot about a bracket pivot axis.

In some implementations, the locking rod defines a rod pivoting end and a rod free end opposite the rod pivoting end, the rod pivoting end being pivotally mounted to the load-carrier arm so as to pivot about a rod pivot axis.

In some implementations, the bracket portion of the locking assembly comprises a guide portion protruding from the main bracket and adjacent to the bracket locking end, the guide portion defining a rod-receiving channel extending substantially parallel to the main bracket with the locking rod being inserted therein, the locking rod being translatable in the rod-receiving channel in the released configuration of the arm restraint.

In some implementations, the bracket portion of the locking assembly further comprises a locking element including the bracket locking surface and a biasing device operatively engaged with the locking element and biasing the bracket locking surface of the locking element towards the rod locking surface when the carriage is located outside the arm restraint-disengaged section.

In some implementations, the guide portion defines a lock-receiving cavity in which the locking element is received and a section of the locking rod extends.

In some implementations, the lifting post comprises a base supporting the lifting post on the floor and the main bracket comprises a lever abutting at least one of the floor and the base when the carriage is positioned in the arm restraint-disengaged section along the post structure to configure the arm restraint in a released configuration.

In some implementations, the locking assembly further comprises a lock transmission assembly operatively coupling the locking element to the lever so as to allow the displacement of the locking element between an engaged configuration and a disengaged configuration in accordance with a configuration of the lever with the locking element being configured in the disengaged configuration when the lever is abutting at least one of the floor and the base.

In some implementations, the lock transmission assembly comprises: a transmission link extending between a first end and a second end, the first end being operatively coupled to the lever; a locking portion connector coupled to the locking element and translating therewith between the engaged and disengaged configurations; an articulated connection connecting the locking portion connector to the transmission link; and the biasing device operatively connected to the locking portion connector for biasing the locking element into the engaged configuration when the lever is substantially free of external pressure applied thereon.

In some implementations, the lever defines a base-engageable end and a bracket-connecting end, opposite the base-engageable end, the bracket-connecting end being pivotally mounted to main bracket and pivotable about a lever pivot axis.

In some implementations, the first end of the transmission link is pivotally mounted to the bracket-connecting end at a lever connection point spaced apart from the lever pivot axis.

In some implementations, the main bracket further comprises an articulation plate support extending downwardly from a lower surface of the main bracket and the articulated connection comprises: an articulation plate defining a first articulation axis, a second articulation axis and a third articulation axis, the second end of the transmission link being pivotally coupled to the articulation plate at the first articulation axis, the articulation plate being pivotally mounted and coupled to the articulation plate support and pivotable about the second articulation axis; and a connector link extending between a first link end and a second link end, the first link end being pivotally mounted and coupled to the articulation plate at the third articulation axis, the second link end being pivotally mounted and coupled to a lower end of the locking portion connector of the lock transmission assembly.

In some implementations, the biasing device extends between the main bracket and the locking element when the lever is substantially free of external pressure applied thereon, the locking element is pushed towards the locking rod for engagement of the locking surfaces.

In some implementations, the biasing device is a coiled spring surrounding a section of the locking portion connector.

In some implementations, the locking portion connector extends through the main bracket into a connector channel extending therethrough and adjacent to the bracket locking end, the locking portion connector being translatably inserted in the connector channel with sections of the locking portion connector extending outwardly of the main bracket at both ends, the locking element being mounted to an upper end of the locking portion connector.

In some implementations, a diameter of the connector channel is larger adjacent to the locking element to define a biasing device-receiving recess with a portion of the biasing device being inserted into the biasing device-receiving recess.

In some implementations, the main bracket defines a longitudinally-extending segment and a bracket pivoting segment extending upwardly from the longitudinally-extending segment, wherein a distal end of the bracket pivoting segment is pivotally mounted to carriage and pivotable about the bracket pivot axis.

In some implementations, the bracket locking surface and the rod locking surface are automatically engaged together when the carriage raised above the arm restraint-disengaged section, thereby preventing relative displacement of the main bracket and the locking rod and pivoting of the load-carrier arm.

In accordance with a further embodiment, there is provided a method for lifting a vehicle with a lift, the method comprising: positioning the vehicle between at least two lifting posts with load-carrier arms being located in an arm restraint-disengaged section of the at least two lifting posts and therefore being pivotable with respect to the at least two lifting posts, with arm restraints of the at least two lifting posts abutting at least one of a floor and a base of the at least two lifting posts; positioning the load-carrier arms in a lifting configuration under the vehicle; and raising the load-carrier arms along the at least two lifting posts and above the arm restraint-disengaged section of the at least two lifting posts, thereby disengaging the arm restraints from the at least one of the floor and the base and automatically configuring the arm restraints in the locked configuration preventing pivoting of the load-carrier arms with respect to the at least two lifting posts.

BRIEF DESCRIPTION OF THE DRAWINGS

Other objects, advantages and features will become more apparent upon reading the following non-restrictive description of embodiments thereof, given for the purpose of exemplification only, with reference to the accompanying drawings in which.

DETAILED DESCRIPTION

Figure 1:
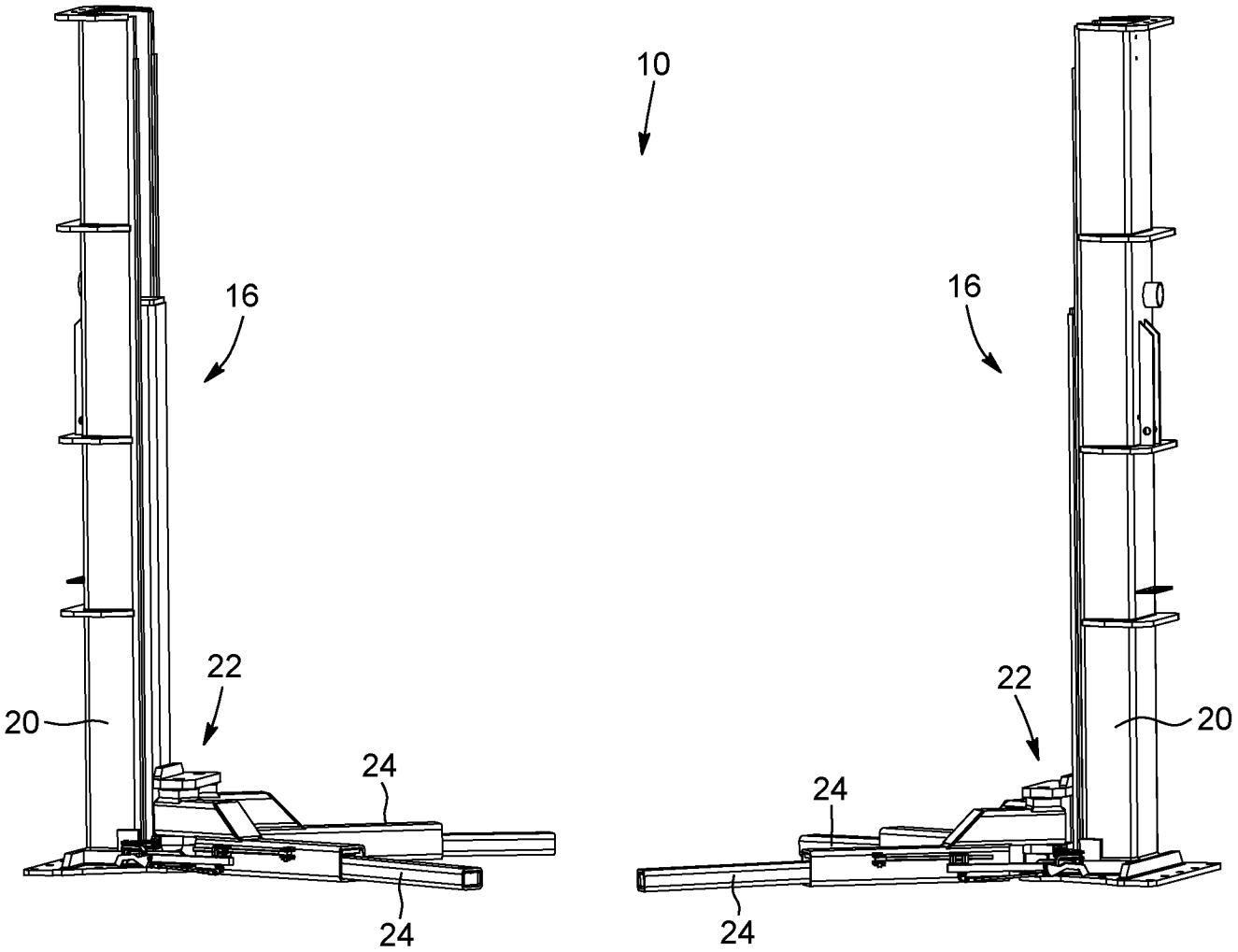
FIG. 1 is a perspective view of a vehicle lift in accordance with an embodiment.

In the following description, the same numerical references refer to similar elements. Furthermore, for the sake of simplicity and clarity, namely so as to not unduly burden the figures with several reference numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures or described in the present disclosure are embodiments only, given solely for exemplification purposes.

Furthermore, in the context of the present description, it will be considered that all elongated objects will have an implicit "longitudinal axis" or "centerline", such as the longitudinal axis of a shaft for example, or the centerline of a biasing device such as a coiled spring, for example, and that expressions such as "connected" and "connectable", or "mounted" and "mountable", may be interchangeable, in that the present vehicle lift or arm restraint also relate to kits with corresponding components for assembling a resulting fully-assembled and fully-operational vehicle lift.

It is appreciated that other heavy loads can be lifted using the present lift assembly including but not being limited to vehicles.

Moreover, components of the present vehicle lifts, arm restraints and/or steps of the method(s) described herein could be modified, simplified, altered, omitted and/or interchanged, without departing from the scope of the present disclosure, depending on the particular applications which the present lift is intended for, and the desired end results, as briefly exemplified herein and as also apparent to a person skilled in the art.

In addition, although the embodiments as illustrated in the accompanying drawings comprise various components, and although the embodiments of the present vehicle lift and corresponding portion(s)/part(s)/component(s) as shown consist of certain geometrical configurations, as explained and illustrated herein, not all of these components and geometries are essential and thus should not be taken in their restrictive sense, i.e. should not be taken so as to limit the scope of the present disclosure. It is to be understood, as also apparent to a person skilled in the art, that other suitable components and cooperation thereinbetween, as well as other suitable geometrical configurations may be used for the present vehicle lift and arm restraint and corresponding portion(s)/part(s)/component(s) according to the present vehicle lift and arm restraint, as will be briefly explained herein and as can be easily inferred herefrom by a person skilled in the art, without departing from the scope of the present disclosure.

To provide a more concise description, some of the quantitative and qualitative expressions given herein may be qualified with the terms "about" and "substantially". It is understood that whether the terms "about" and "substantially" are used explicitly or not, every quantity or qualification given herein is meant to refer to an actual given value or qualification, and it is also meant to refer to the approximation to such given value or qualification that would reasonably be inferred based on the ordinary skill in the art, including approximations due to the experimental and/or measurement conditions for such given value.

The present disclosure describes vehicle lifts, and more particularly arm restraints, that are configured so as to prevent a load-carrier arm of the vehicle lift to pivot when the vehicle is being lifted above the ground surface, and which, by virtue of their designs and components, overcome or at least minimize some of the above-discussed drawbacks.

Figure 2:
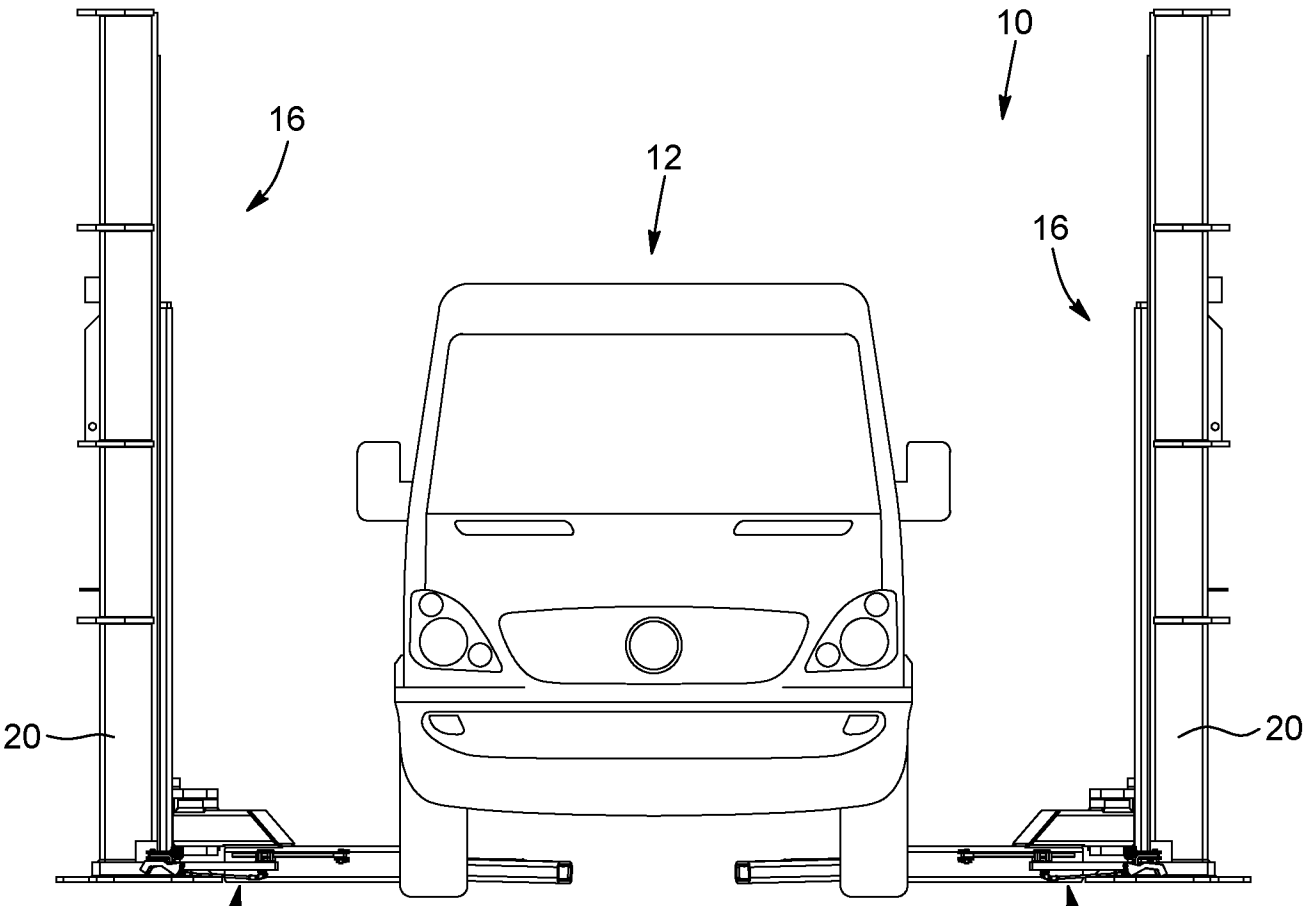
FIG. 2 is a front elevation view of the vehicle lift of FIG. 1, where a vehicle is shown ready to be lifted as the carriages are being positioned about the ground surface.
Figure 3:
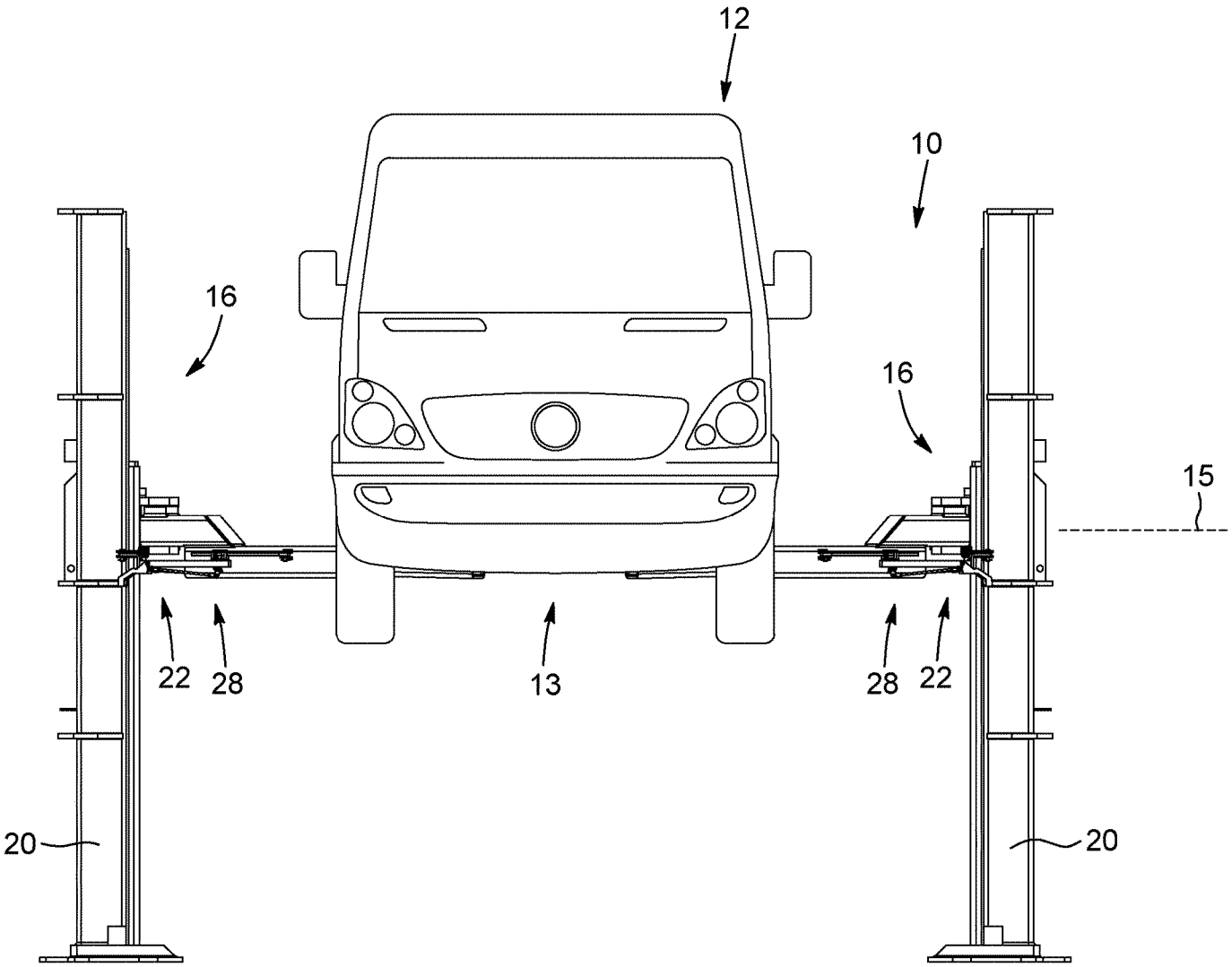
FIG. 3 is a front elevation view of the vehicle lift of FIG. 1, where the vehicle is shown in its lifted configuration, the carriages being positioned at a vehicle lifted level.

Referring now the drawings and more particularly to FIGS. 1 to 3, there is shown a vehicle lift 10 which is configured and adapted to allow lifting of a vehicle 12 above a ground surface 14 (or above the floor). Vehicle lift or lift 10 includes two spaced apart lifting posts 16 which are positioned so as to allow a vehicle 12, such as a car or a truck, to be positioned therebetween. Each lifting post 16 includes a base 18 (FIG. 4) for resting on ground surface 14, a post structure 20 which upwardly extends upwardly from base 18 and a carriage 22 which is slidably and operatively mounted to post structure 20. As shown, base 18 is provided with a plurality of apertures so it can be secured to ground surface 14 using a plurality of suitable mechanical fasteners for example. As best illustrated in FIGS. 2 and 3, each carriage 22 is configured so as to slide along a corresponding post structure 20 between adjacent to ground surface 14 (FIG. 2) and a vehicle lifted level 15 (FIG. 3), so that vehicle 12 positioned on ground surface 14 between lifting posts 16 (FIG. 2) can be lifted until it reaches vehicle lifted level 15 (FIG. 3). For example, each lifting post 16 can include hydraulically or electrically operated lifting actuators (not shown) operatively coupled to carriages 22 for allowing their vertical displacement from ground surface 14 and along post structure 20.

Referring to FIGS. 1 to 5, there is shown that each lifting post 16 of vehicle lift 10 further includes two load-carrier arms 24. Each load-carrier arm 24 is pivotally mounted to its corresponding carriage 22 so as to engage with an underside 13 of vehicle 12 to be lifted. Each load-carrier arm 24 is being pivotable about a vertical pivot axis 26, in a plan which is substantially parallel to ground surface 14.

In the embodiment shown, each lifting post 16 of vehicle lift 10 further includes two load-carrier arms 24. However, it is appreciated that, in alternative embodiments (not shown), each lifting post 16 can include one or more than two load-carrier arms 24.

Still referring to FIGS. 1 to 5, there is shown that an arm restraint 28 is coupled to each one of the load-carrier arms 24 and is configured so as to operate between a released configuration (FIGS. 2 and 4), where the load-carrier arm is located adjacent to the ground surface and a portion of the arm restraint 28 engages with base 18 (or any other suitable surface), thereby allowing load-carrier arm 24 to pivot about vertical axes 26, and a locked configuration (FIGS. 3 and 5), where carriages 22 and load-carrier arms 24 are located away from ground surface 14, thereby preventing load-carrier arms 24 to pivot about their respective vertical axes 26.

Figure 4:
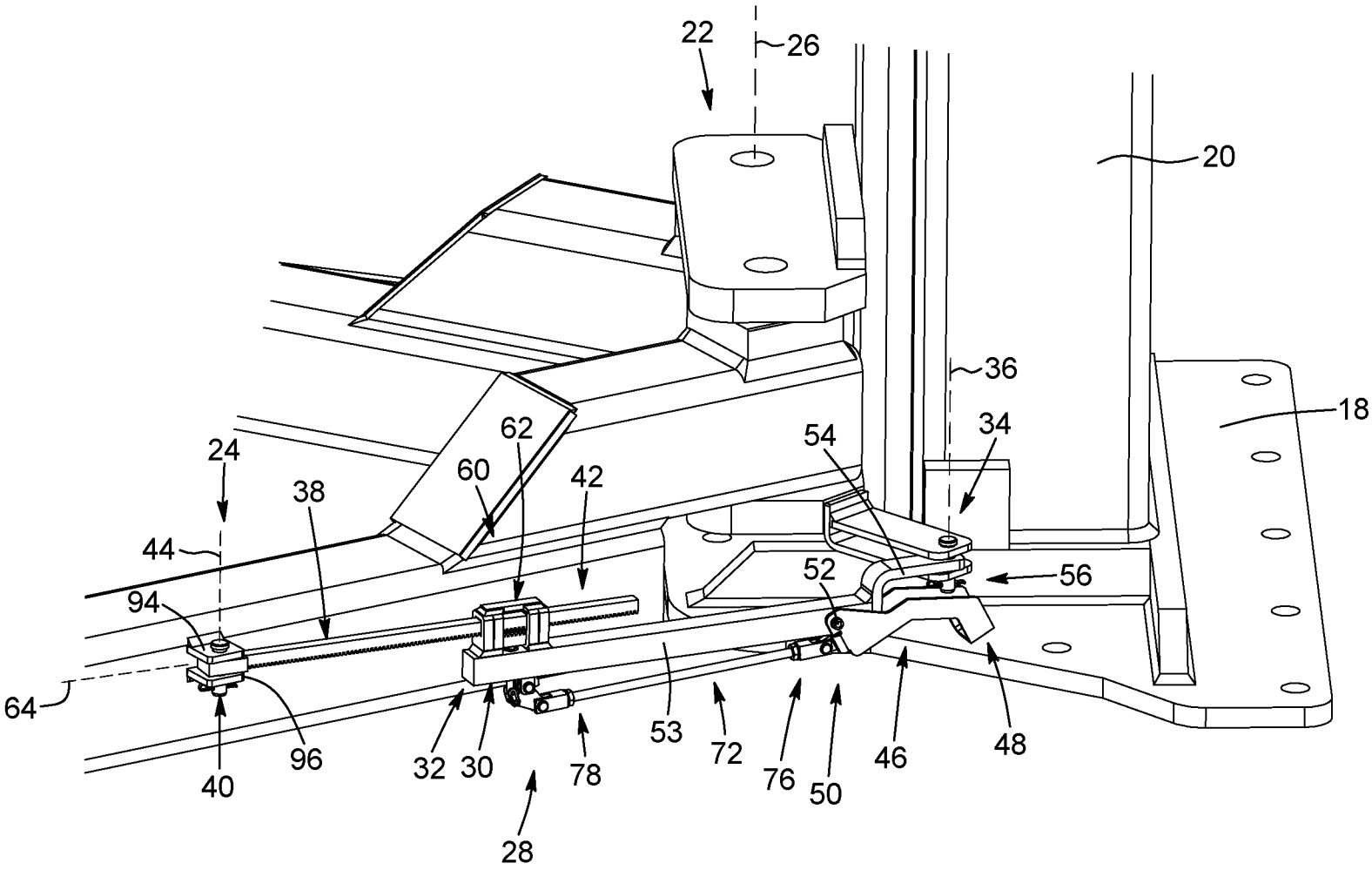
FIG. 4 is a closed-up perspective view of an arm restraint of the vehicle lift of FIG. 1, the arm restraint being shown in its released configuration allowing the load-carrier arm to pivot.
Figure 5:
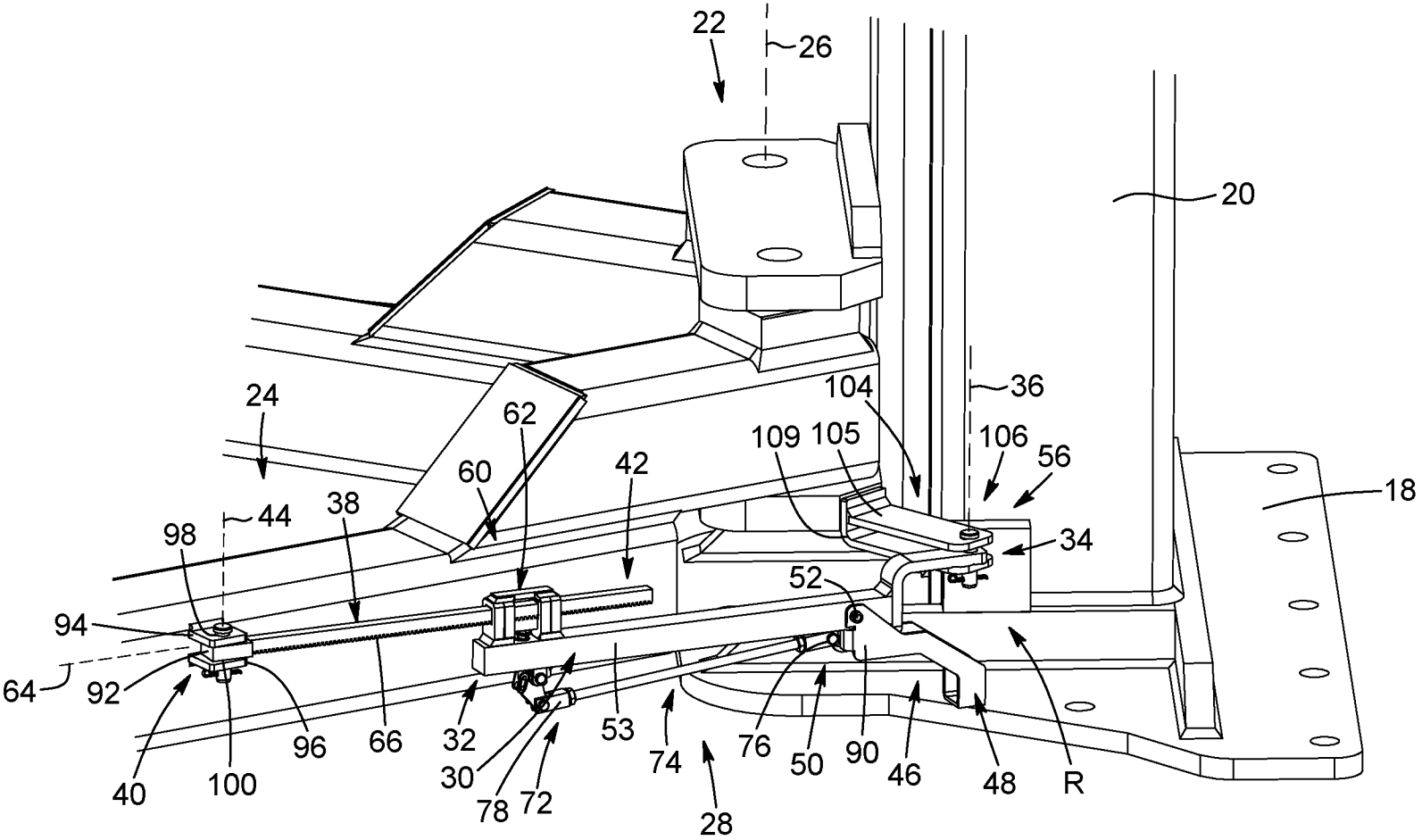
FIG. 5 is a closed-up perspective view of the arm restraint of FIG. 3, the arm restraint being shown in its locked configuration preventing the load-carrier arm to pivot.

Referring to FIGS. 4 and 5, in the non-limitative embodiment shown, the carriage 22 includes an extension arm 104, which is defined, in the non-limitative embodiment shown, by two spaced apart plates 105, 109, with an extension arm distal end 106. The extension arm 104 translates with the remaining components of the carriage 22 along the post structure 20. Leg through holes are defined at extension arm distal end 106 to receiving a pivot axis of a respective one of the arm restraints 28, as will be described in more details below. In other words, the arm restraints 28 are connected to the carriage 22 to be displaceable along the post structure 20 through the connection with the extension arm 104.

Since all arm restraints 28 of the vehicle lift 10 are similar, only one will be described in the following paragraphs.

Referring now more particularly to FIGS. 4 to 8, there is shown that arm restraint 28 includes a main bracket 30 mounted to the carriage 22. Main bracket 30 defines a bracket locking end 32 and a bracket pivoting end 34, which is found opposite bracket locking end 32. Bracket pivoting end 34 is pivotally mounted to carriage 22 so as to pivot about a bracket pivot axis 36 (vertical axis 36 for example).

Each arm restraint 28 further includes a locking rod 38 mounted to the load-carrier arm 24. Locking rod 38 defines a rod pivoting end 40 and a rod free end 42, which is found opposite rod pivoting end 40. Rod pivoting end 40 is pivotally mounted to a side wall of load-carrier arm 24 so as to pivot about a rod pivot axis 44 (vertical axis 44 for example). As well illustrated, rod pivot axis 44 is spaced apart from bracket pivot axis 36. As it will be described in more details herein, locking rod 38 is capable of locking engagement with main bracket 30.

Figure 9:
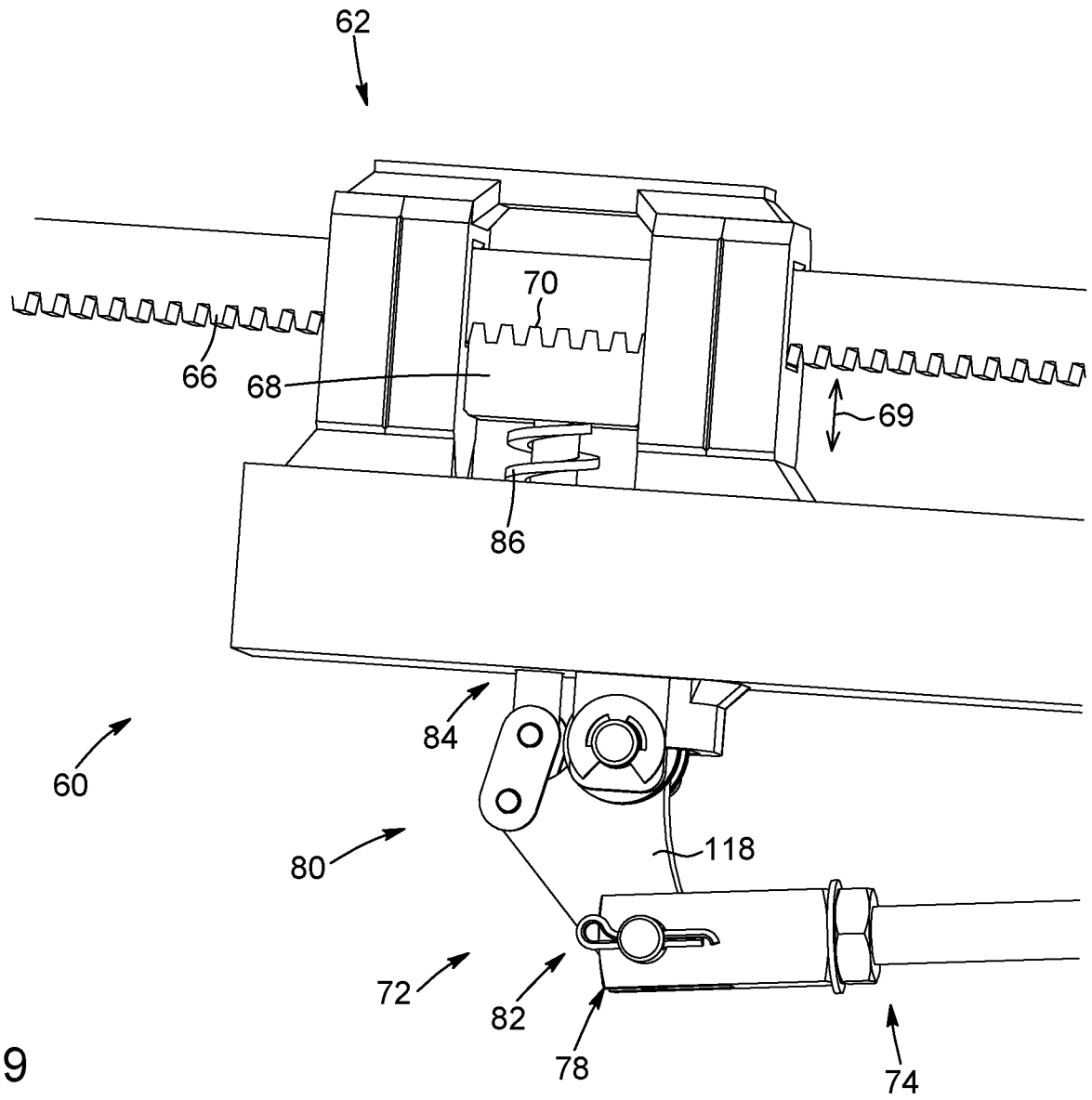
FIG. 9 is a closed-up perspective view of the arm restraint of FIG. 5, showing the locking rod being in locking engagement with the main bracket.

In the non-limitative embodiment shown and referring to FIGS. 5 and 9, the locking rod 38 of the arm restraint 28 further includes a connecting plate 92 at its rod pivoting end 40 for allowing pivot of locking rod 38 relatively to a side wall of load-carrier arm 24. Arm restraint 28 further includes a pair of spaced-apart plates 94, 96 secured to and extending laterally from the side wall of load-carrier arm 24. Indeed, the two plates 94, 96 are spaced-apart from one another to receive connecting plate 92 therebetween. Plate through holes 98, 100, 102 are defined respectively in the plates 94, 96 and the connecting plate 92. The plate through holes 98, 100, 102 are aligned and configured, shaped and/or sized so as to receive a pivoting and connecting rod therein, thereby allowing the connecting plate 92 to pivot about rod pivot axis 44 (or rod pivot).

Thus, the arm restraint 28 includes the main bracket 30, mounted to the carriage 22, and the locking rod 38, mounted to the load-carrier arm 24. Each one includes, directly or indirectly, a locking surface, as will be described in more details below. The locking surfaces of the main bracket 30 and the locking rod 38 are engageable together to configure the arm restraint 28 in the locked configuration and thereby prevent relative displacement of the main bracket 30 and the locking rod 38, thereby preventing load-carrier arm 24 to pivot about its respective vertical axis 26. When the locking surfaces of the main bracket 30 and the locking rod 38 are disengaged from one another, the arm restraint 28 is configured in the released configuration and relative displacement of the main bracket 30 and the locking rod 38 is allowed, thereby allowing load-carrier arm 24 to pivot about its respective vertical axis 26.

Still referring to FIGS. 4 to 8, there is shown that arm restraint 28 further includes a lever 46. Lever 46 defines a base-engageable end 48 and a bracket-connecting end 50, found opposite base-engageable end 48. Lever 46 is being pivotally mounted to main bracket 30 so as to pivot about a lever pivot axis 52 (horizontal axis 52 for example).

Still referring to FIGS. 4 to 8, main bracket 30 defines a longitudinally-extending segment 53, as well as a bracket pivoting segment 54, which upwardly extends from longitudinally-extending segment 53. Bracket pivoting segment 54 with a distal end 56 pivotally mounted to carriage 22 so as to pivot about bracket pivot axis 36, as mentioned above. More particularly, bracket pivoting segment 54 has a bracket pivoting segment through hole 111 (FIG. 6) extending therethrough at bracket segment distal end 56 which is aligned with the leg through holes defined at extension arm distal end 106 of the extension arm 104. Therefore, the leg through holes and the bracket pivot axis 36 (or bracket pivot) and provide a pivotable connection between the extension arm 104 of the carriage 22 and the bracket pivoting segment 54 of the respective one of the arm restraints 28. The arm restraints 28 are thus pivotally connected to the carriage 22 through the extension arm 104 and displaceable along the post structure 20 simultaneously with the carriage 22.

In the non-limitative embodiment shown, lever 46 comprises two spaced-apart lever plates 112, 114, extending parallel to one another. Lever 46 includes a main bracket receiving portion 116 which is configured, shaped and/or sized so as to receive bracket pivoting end 34 to be pivotable thereabout. More particularly, longitudinally-extending segment 53 of main bracket 30 defines a lever interfacing portion 58 which is configured, shaped and/or sized so as to be received inbetween spaced-apart lever plates 112, 114 about bracket-connecting end 50 of lever 46.

Arm restraint 28 further includes a locking assembly 60 configured to provide the locking engagement between main bracket 30 and locking rod 38 (FIGS. 4 and 5) and, thereby, prevent relative translation inbetween. In the non-limitative embodiment shown, the locking assembly 60 comprises a bracket portion mounted to or provided on the main bracket 30 and a rod portion mounted to or provided on the locking rod 38. Each one of the bracket portion and the rod portion includes one of the locking surfaces, which are engageable together to configure the arm restraint 28 in the locked configuration.

In the non-limitative embodiment shown, the bracket portion of the locking assembly 60 includes a guide portion 62 (FIGS. 4, 5, 6 and 9) which upwardly extends from longitudinally-extending segment 53 adjacent to bracket locking end 32. Guide portion 62 defines a rod-receiving channel 63 extending substantially parallel to the longitudinally-extending segment 53 of the main bracket 30, along a longitudinal axis 64, and into which the locking rod 38 extends. In the released configuration, the guide portion 62 is configured for allowing longitudinal displacement (or translation) of locking rod 38 therein, as it will be described in more details herein.

Figure 6:
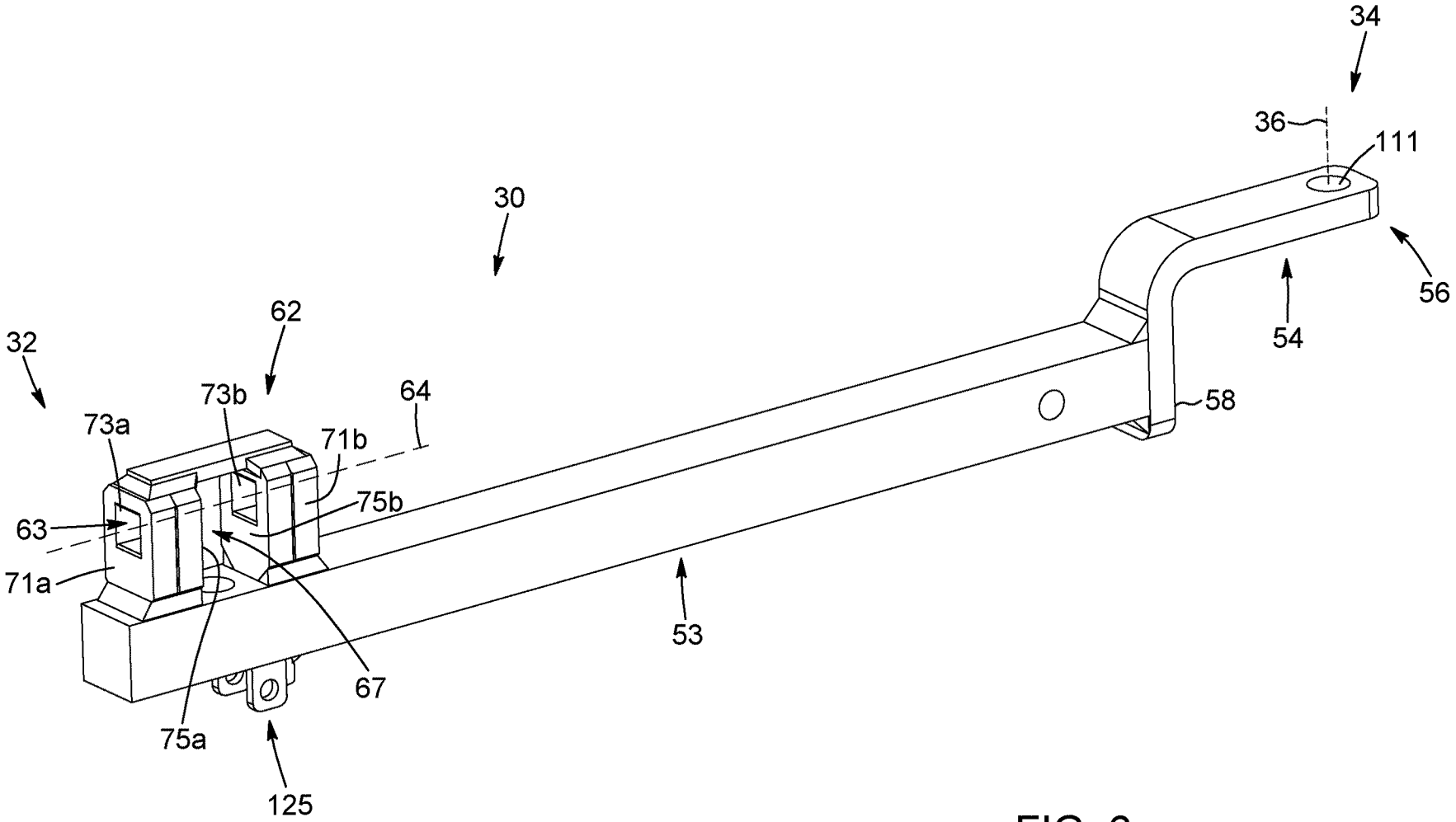
FIG. 6 is a top perspective view of a main bracket of the arm restraint of FIGS. 4 and 5.

Referring more particularly to FIGS. 6 and 9, there is shown that guide portion 62 includes two rod receiving members 71*a*, 71*b* which extend from an upper surface of main bracket 30. The rod receiving members 71*a*, 71*b* are spaced apart from one another to define a lock-receiving cavity 67 inbetween. Each one of the rod receiving members 71*a*, 71*b* has an aperture 73*a*, 73*b* defined therein. The two apertures 73*a*, 73*b* are aligned and, in some implementations, in register to define together the rod-receiving channel 63 in which the locking rod 38 is inserted and extends along longitudinal axis 64.

It is appreciated that the guide portion 62 of the locking assembly 60 could be provided on or mounted to the locking rod 38 in an alternative embodiment (not shown).

Figure 10:
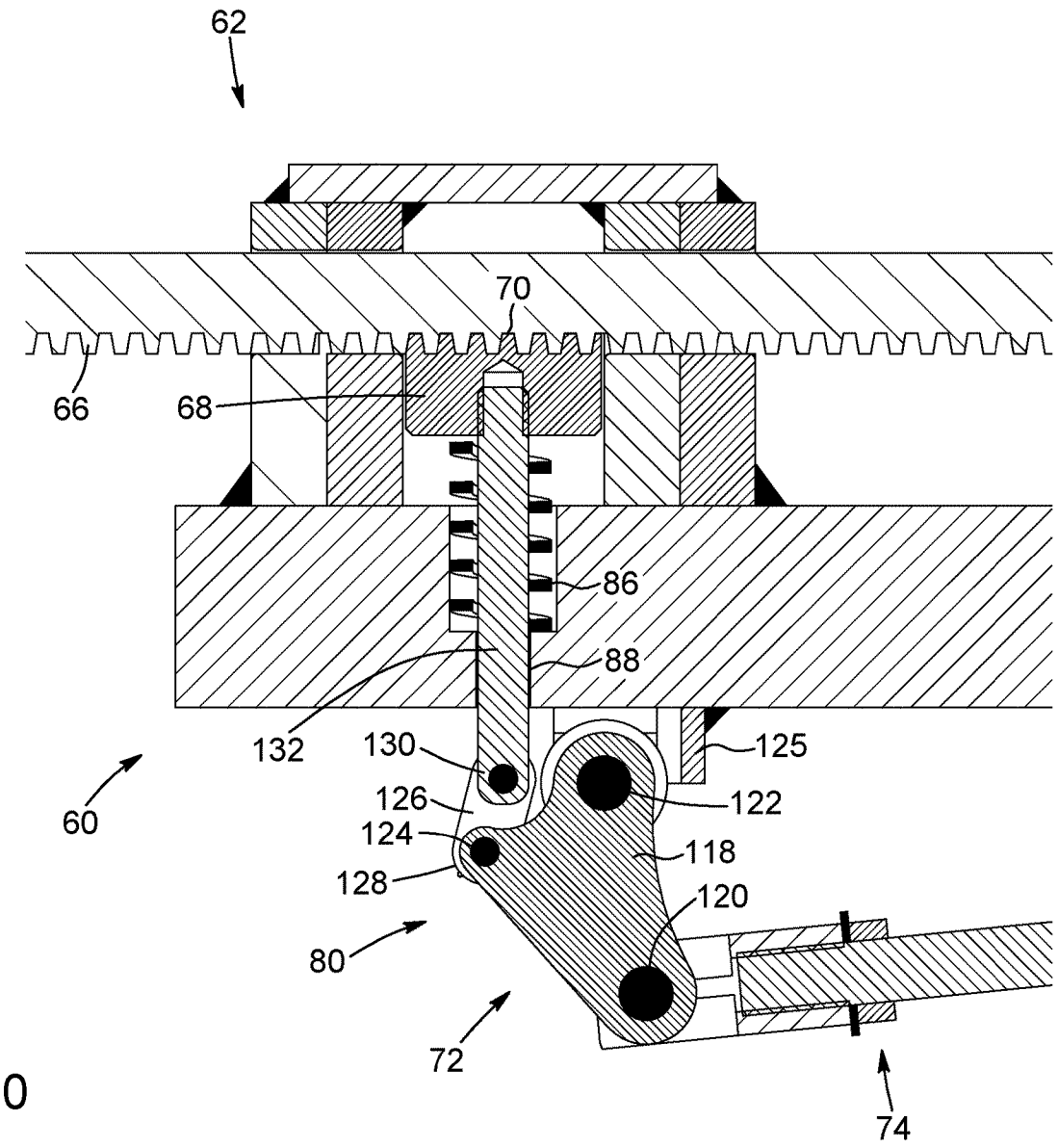
FIG. 10 is a cross-sectional view of the arm restraint of FIG. 9, showing the locking rod being in locking engagement with the main bracket.

In the non-limitative embodiment shown, the bracket portion of the locking assembly 60 further includes a locking element 68 which is capable of displacement within lock-receiving cavity 67, inbetween the two rod supports or rod receiving members 71*a*, 71*b*, along a vertical displacement axis 69 (FIG. 9). Locking element 68 defines a bracket locking surface 70, i.e. the locking surface of the guiding bracket 30, which faces a complementary or corresponding rod locking surface 66 which is defined on the locking rod 38. As shown in FIG. 10, the locking surfaces 66, 70 face each other and are engageable together, as will be described in more details below. Even though the locking surfaces 66, 70 are illustrated as being surfaces with complementary protrusions and grooves (or a plurality of consecutive teeth), a person skilled in the art to which arm restraint 28 pertains would understand that any suitable locking assemblies or surfaces may be provided to the locking rod 38 and/or the locking element 68, as long as it prevents horizontal displacement of locking rod 38 along longitudinal axis 64 and relatively to main bracket 30, once locking engagement is provided between locking element 68 and locking rod 38. For example, one pin or more can extend upwardly from an upper surface of locking element 68, while an under surface of locking rod 38 may be provided with corresponding aperture(s) shaped and sized to receive the pin(s). Locking element 68 is capable of displacement (of vertical displacement for example) between a locked configuration (FIGS. 5, 9 and 10), where bracket locking surface 70 engages with rod locking surface 66, thus preventing longitudinal displacement of locking rod 38 along longitudinal axis 64, and a released configuration (FIGS. 4 and 11), where bracket locking surface 70 is disengaged from rod locking surface 66, thus allowing longitudinal displacement of locking rod 38 along longitudinal axis 64.

It is to be noted that even though guide portion 62 and main bracket 30 are illustrated as being integrally formed they can be provided as separate components which can be connected together using suitable connecting elements.

As shown in FIGS. 6 and 9, each one of first and second rod receiving members 71*a*, 71*b* has an internal side wall, respectively internal side wall 75*a* and internal side wall 75*b*. As it vertically travels within lock-receiving cavity 67, side walls of locking element 68 interface with internal side walls 75*a*, 75*b* of both first and second rod receiving members 71*a*, 71*b*.

Referring to FIGS. 4, 5 and 9 to 11, there is shown that locking assembly 60 further comprises a lock transmission assembly 72 which is operatively coupling the locking element 68 to the lever 46 so as to allow the displacement of the locking element 68 between its locked configuration (FIGS. 5, 9 and 10) and its released configuration (FIGS. 4 and 11) in accordance with the configuration of the lever 46. The lock transmission assembly 72 includes a transmission link 74, an articulated connection 80, a locking portion connector 132, and a biasing device 86. The articulated connection 80 connects the locking portion connector 132 to the transmission link 74. The transmission link 74 is operatively coupled to the lever 46 while the locking portion connector 132 is coupled to the locking element 68. The biasing device 86 biases the locking element 68 into the locked configuration when no external pressure is applied on the lever 46 as will be described in more details below.

The transmission link 74 of the lock transmission assembly 72 extends between a first end 76 and a second end 78. The first end 76 of the transmission link 74 is mounted to and coupled to lever 46. More particularly, the first end 76 of the transmission link 74 is pivotally mounted to bracket-connecting end 50 (at lever connection point 90) of the lever 46.

Turning now to FIGS. 9 and 10, there is shown that the articulated connection 80 of the lock transmission assembly 72 is composed of a plurality of connected parts, which defines a first end 82 and a second end 84 of the articulated connection 80. The articulated connection 80 includes an articulation plate 118 which defines a first articulation axis 120 (a horizontal axis for example), a second articulation axis 122 (a horizontal axis for example) and a third articulation axis 124 (a horizontal axis for example). The second end 78 of the transmission link 74 is being pivotally coupled to the first end 82 of the articulated connection 80 and, more particularly, pivotally coupled to articulation plate 118 at first articulation axis 120 so that the articulation plate 118 and the second end 78 of the transmission link 74 can pivot with respect to one another. The articulation plate 118 is pivotally mounted to and supported by an articulation plate support 125, which is secured to and downwardly extends from main bracket 30. Therefore, the articulation plate 118 is pivotally mounted and coupled to the articulation plate support 125 and pivotable about second articulation axis 122. Articulated connection 80 also includes a connector link 126 extending between a first link end 128 and a second link end 130. The first link end 128 of the connector link 126 is pivotally mounted to and coupled to articulation plate 118 at third articulation axis 124, while second link end 130 of the connector link 126 is pivotally mounted to and coupled to an end of the locking portion connector 132 of the lock transmission assembly 72.

The biasing device 86 is operatively connected to the locking portion connector 132 and biases the locking element 68 into the locked configuration when no external pressure is applied on the lever 46. In the non-limitative embodiment shown, the biasing device 86 is embodied by a coiled spring 86 which surrounds a section of the locking portion connector 132. The biasing device 86 extends between the main bracket 30 and the locking element 68 and when no external pressure is applied it pushes the locking element 68 towards the locking rod 38 for engagement of their complementary locking surfaces 66, 70.

The locking portion connector 132 extends through the main bracket 30 into a connector channel 88 extending therethrough, adjacent to the bracket locking end 32. The locking portion connector 132 is translatably inserted in the connector channel 88 with sections of the locking portion connector 132 extending outwardly of the main bracket 30 at both ends. As mentioned above, at a first end, the locking portion connector 132 pivotally coupled to second link end 130 of the connector link 126. The locking element 68 is mounted to the second end of the locking portion connector 132.

In the non-limitative embodiment shown, a diameter of the connector channel 88 is larger adjacent to the locking element 68 to define a biasing device-receiving recess and a portion of the biasing device 86 is inserted into the biasing device-receiving recess. A first end of the biasing device 68 abuts against a lower surface of the biasing device-receiving recess while its opposed end abuts against the locking element 68. The biasing device is configurable between a compacted configuration (FIGS. 4 and 11) and a resting (released or expanded) configuration (FIGS. 5, 9 and 10). In the resting (released or expanded) configuration, the locking element 68 is pushed upwardly, towards the locking rod 38, and their complementary locking surfaces 66, 70 are engaged together to prevent displacement of locking rod 38 relatively to main bracket 30. On the contrary, when the locking portion connector 132 is pulled downwardly, the biasing device 86 is configured the compacted configuration (FIGS. 4 and 11) and the locking element 68, which is mounted to the locking portion connector 132 is displaced downwardly, spaced-apart from the locking rod 38. Their locking surfaces 66, 70 are disengaged which allows displacement of locking rod 38 relatively to main bracket 30.

The biasing device 86 biases the locking portion connector 132 towards the locking rod 38, i.e. upwardly in the non-limitative embodiment shown, and, thereby, in the locked configuration.

It is to be noted that first end 76 of the transmission link 74 is being coupled to lever 46 at a lever connection point 90 which is spaced-apart from lever pivot axis 52. Indeed, lever connection point 90 is located substantially below lever pivot axis 52. The functionality of such configuration will be explained in more details below.

Figure 7:
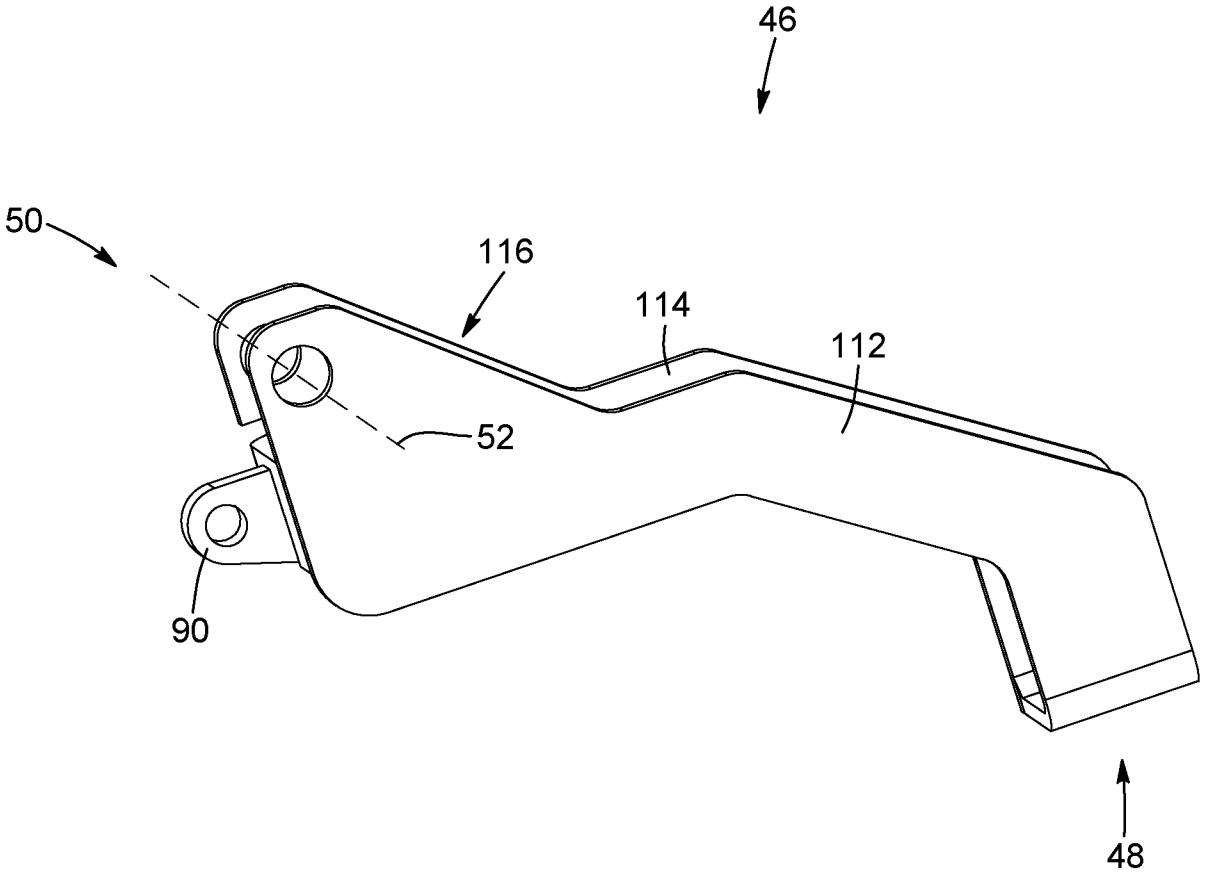
FIG. 7 is a top perspective view of a lever of the arm restraint of FIGS. 4 and 5.
Figure 8:
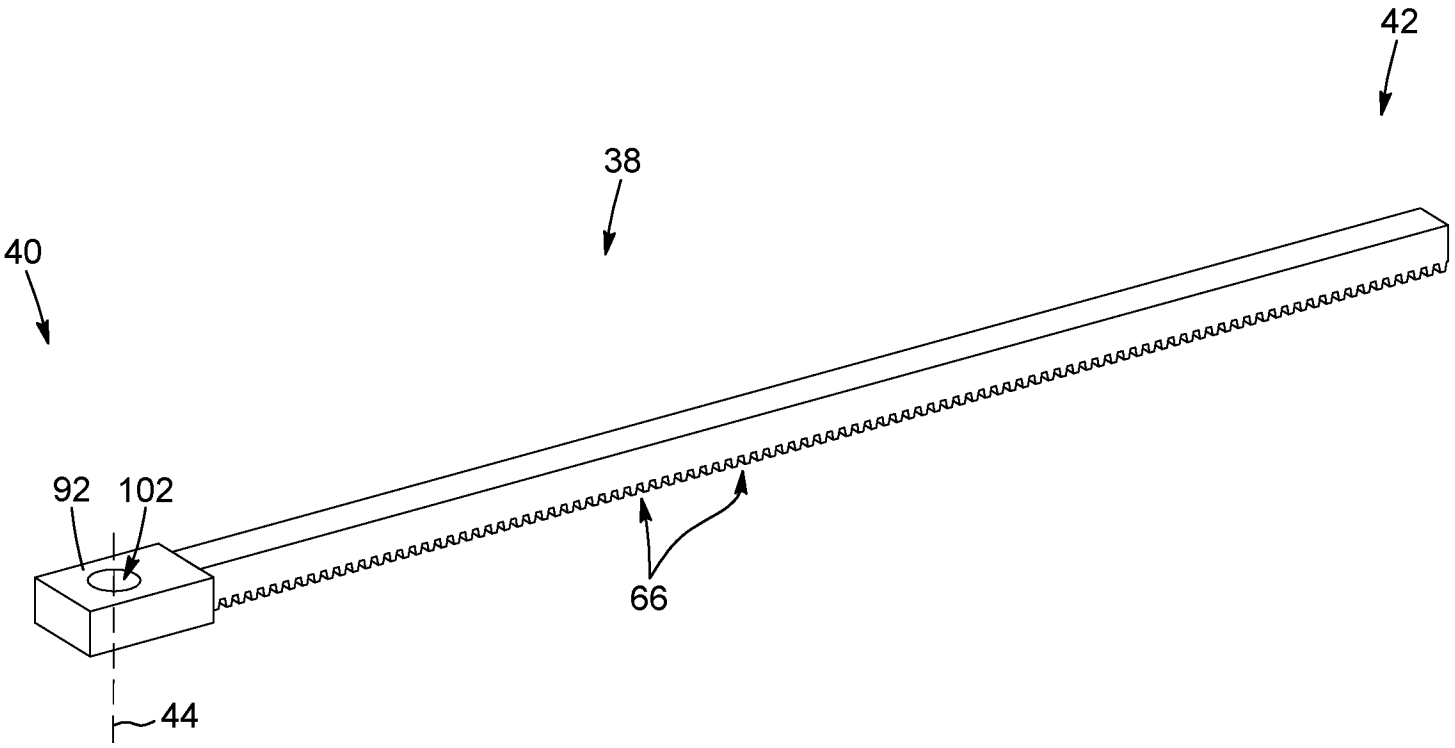
FIG. 8 is a top perspective view of a locking rod of the arm restraint of FIGS. 4 and 5.

Now referring more particularly to FIGS. 4, 5 and 7, it is to be noted that lever 46 is configured to pivot about lever pivot axis 52 between a lever disengaged configuration (FIG. 5) and a lever pivoted (engaged) configuration (FIG. 4). The lever 46 is configured in the lever pivoted configuration (FIG. 4) when base-engageable end 48 of lever 46 interfaces with a surface or when pressure is applied thereon. In the embodiment shown, when the carriage 22 and the load-carrier arm 24 mounted thereto are positioned in an arm restraint-disengaged section of the post structure 20, the arm restraint 28 is automatically configured in the disengaged configuration wherein the load-carrier arm 24 is pivotable. In the embodiment shown, the arm restraint-disengaged section corresponds to a lever engaged section of the post structure 24, i.e. a section along the post structure 20 wherein the lever 46 contacts the base 18 of lifting post 16 (or the floor) and is automatically configured in the lever pivoted (engaged) configuration, which corresponds to the disengaged configuration of the arm restraint 28. Thus, the lever engaged section of the post structure 20 corresponds to a section of the post structure 20 wherein the lever 46 is configured in the lever pivoted (engaged) configuration. However, it is appreciated that, when the carriage 22 and the load-carrier arm 24 mounted thereto are positioned in the lever engaged section of the post structure 20, the base-engageable end 48 of lever 46 could contact the floor or any other suitable surface to be configured into the lever pivoted configuration. When the base-engageable end 48 of lever 46 is disengaged from a surface, such as the base 18 of lifting post 16, or when pressure is relieved therefrom, the lever 46 is reconfigured in the lever disengaged configuration. In some implementations, it includes a lowest position that the carriage 22/load-carrier arm 24 can reach along the post structure 20 and it can also include a section of the post structure 20 extending upwardly from the lowest position and wherein the lever 46 is still configured in the lever pivoted (engaged) configuration.

It is to be mentioned that even though vehicle lift 10 is illustrated in the accompanying drawings as comprising two spaced apart lifting posts 16, where each one of the lifting posts 16 includes two load-carrier arms 24 so as to provide a four-point support to vehicle 12, a person skilled in the art to which vehicle lift 10 pertains would understand that vehicle lift 10 can include one or more lifting post(s) 16, while each lifting post 16 can include one or more load-carrier arm(s) 24. For example, a person skilled in the art may think of a vehicle lift that includes only one lifting post that is provided with two pivotable load-carrier arms or more, or alternatively, of a vehicle lift that includes four spaced apart lifting posts, each lifting post being provided with only one pivotable load-carrier arm. In both scenarios, a four-point support will be provided by the load-carrier arm(s) underneath vehicle 12 for allowing the vehicle to be lifted by the vehicle lift.

Operating the Vehicle Lift and the Arm Restraint

Referring now to FIGS. 2 to 11, in operation, vehicle 12 is displaced on ground surface (or floor) 14 so as to be positioned in between spaced apart hydraulic lifting posts 16, while load-carrier arms 24 are out of the way (either by being retracted or by being pivoted so that they are provided substantially parallel to a vehicle displacement axis). Each one of the arm restraints 28 is provided in its released configuration (FIGS. 2, 4 and 11) so that the load-carrier arms 24 can be pivoted and adjusted beneath vehicle 12.

Figure 11:
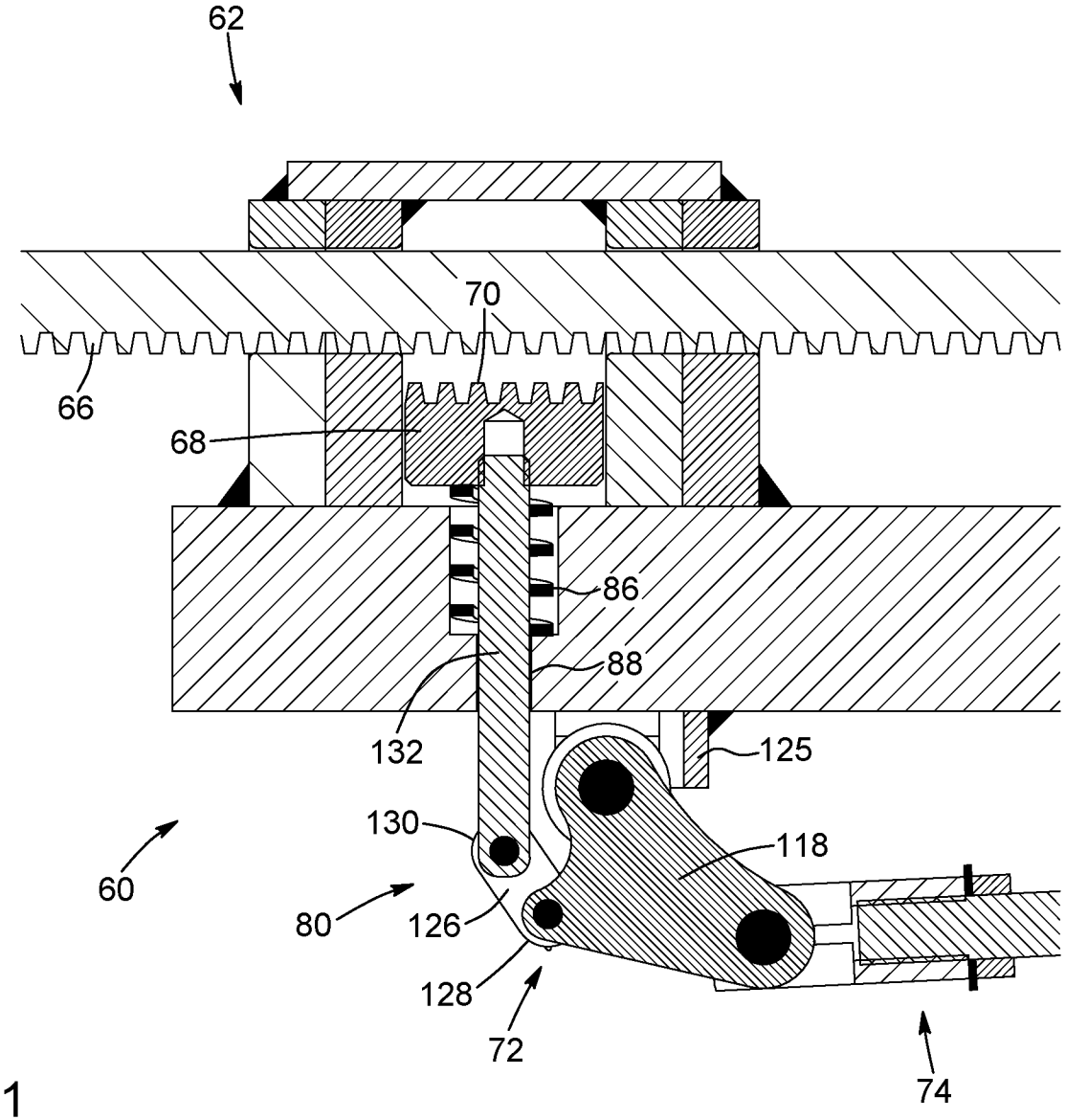
FIG. 11 is a cross-sectional view of the arm restraint, showing the locking rod being disengaged from the main bracket.

Released Configuration of Arm Restraint (FIGS. 2, 4 and 11)

For each one of the lifting posts 16, since carriage 22 is provided about ground surface 14, base-engageable end 48 of lever 46 engages base 18 (or ground surface 14 or floor for example). Alternatively, pressure can be applied on the base-engageable end 48 of lever 46. As best shown in FIG. 4, lever 46 is provided to pivot about lever pivot axis 52 in a counterclockwise rotation R (FIG. 5). Upon pivot of lever 46, transmission link 74, which is linked to lever 46 at lever connection point 90 found below lever pivot axis 52, is provided to move inwardly towards post structure 20, or base 18 for example. Articulation plate 118, which is pivotally linked to transmission link 74, and therefore connector link 126 and locking portion connector 132, are thus provided to move substantially downwardly, towards ground surface 14 for example, which causes locking element 68 to be pulled down, along vertical displacement axis 69 (FIG. 9), so as to reach its released configuration as the biasing device 86 is being compressed. Thus, when the base-engageable end 48 of lever 46 is pivoted upwardly, the locking portion connector 132 having the locking element 68 mounted thereto is displaced downwardly, through the lock transmission assembly 72, thereby being disengaged from the locking rod 38, i.e. the locking surfaces 66, 70 are spaced-apart. Bracket locking surface 70 is at this point disengaged from rod locking surface 66, which allows longitudinal displacement of locking rod 38 within rod-receiving channel 63 along longitudinal axis 64, thereby providing load-carrier arm 24 to pivot about vertical axis 26. Arm restraint 28 is therefore configured, shaped and/or sized so that locking assembly 60 is released (locking rod 38 is capable of longitudinal displacement relatively to main bracket 30) as carriage 22, but more particularly lever 46, approaches ground surface 14, or pressure is applied on the base-engageable end 48 of lever 46.

Locked Configuration of Arm Restraint (FIGS. 3, 5, 9 and 10)

Indeed, as the load carrier arms 24 (in this case providing a four-point support) engage with the underside of vehicle 12 (or even prior to contacting the underside of the vehicle) by being raised through vertical displacement of the carriage 22, arms 24 are automatically prevented to pivot relatively to vertical axis 26.

For each one of the lifting posts 16, as carriage 22 slides along post structure 20 to reach vehicle lifted level 15, lever base-engageable end 48 disengages from base 18 (or alternatively from ground surface 14 for example). Base-engageable end 48 of lever 46 is no longer interfacing with base 18 of lifting post 16. As best shown in FIG. 5, lever 46 is provided to pivot about lever pivot axis 52 in a clockwise direction. Upon pivot of lever 46, transmission link 74, which is linked to lever 46 at lever connection point 90 found below lever pivot axis 52, is provided to move outwardly away from post structure 20, or base 18 for example. Articulation plate 118, which is pivotally linked to transmission link 74, and therefore connector link 126 and locking portion connector 132, are thus provided to move substantially upwardly (to reach its initial position), away from ground surface 14 for example, which causes locking element 68 to be displaced upwardly, along vertical displacement axis 69 (FIG. 9), so as to reach its locked configuration as biasing device 86 is brought back to its initial/resting configuration. Bracket locking surface 70 is at this point in locking engagement with rod locking surface 66, which prevents longitudinal displacement of locking rod 38 within rod-receiving channel 63 along longitudinal axis 64, thereby preventing load-carrier arm 24 to pivot about vertical axis 26. Arm restraint 28 is therefore configured, shaped and/or sized so that locking assembly 60 is automatically reengaged (locking rod 38 is prevented from longitudinally displace relatively to main bracket), as carriage 22, but more particularly lever 46, is raised from ground surface 14.

A person skilled in the art to which arm restraint 28 or vehicle lift 10 pertain would understand that main bracket 30, locking rod 38, lever 46, locking assembly 60 including guide portion 62, locking surfaces 66, 70, locking element 68, lock transmission assembly 72 including transmission link 74, articulated connection 80, biasing device 86, etc. can take other configurations, shapes and/or sizes, as long as it provides disengagement of locking element 68 and locking rod 38 as carriage 22 or arm restraint 28, but more particularly load carrier arms 24, approaches ground surface 14, so as to provide longitudinal displacement of locking rod 38 relatively to locking element 68. For example, a person skilled in the art may think of other assemblies to space apart the locking element 68 relatively to locking rod 38 once lever 46 or any suitable part of the arm-restraint 28 has touched the ground.

In the embodiment shown, the locking element 68 is lowered to be disengaged from the locking rod 38. However, it is appreciated that, in an alternative embodiment (not shown), the locking element 68 could be raised to be disengaged from the locking rod 38.

In the embodiment shown, the biasing device is embodied by a coiled spring but it is appreciated that other biasing devices could be foreseen to return the locking element 68 automatically in the engaged/locked configuration once pressure is released on the lever 46 (or any suitable part of the arm-restraint 28), for instance, by spacing apart the lever 46 from the ground or the base 18.

Although the present invention has been described hereinabove by way of specific embodiments thereof, it can be modified, without departing from the spirit and nature of the subject invention defined in the appended claims.

The invention claimed is:

1. A lift for lifting a heavy load above a floor, the lift comprising:

a lifting post extending upwardly from the floor;

a carriage mounted to the lifting post and vertically displaceable therealong;

a load-carrier arm pivotally mounted to the carriage and vertically displaceable along the lifting post with the carriage; and an arm restraint mounted to the load-carrier arm and vertically displaceable along the lifting post with the carriage and the load-carrier arm, the arm restraint being configurable in a released configuration wherein the load-carrier arm is pivotable with respect to the lifting post and a locked configuration, wherein pivoting of the load-carrier arm with respect to the lifting post is prevented, the arm restraint comprising:

a main bracket mounted to the carriage and including a longitudinally-extending segment;

a locking rod mounted to the load-carrier arm and having a rod portion with a rod locking surface with rod teeth; and a locking assembly comprising a bracket portion provided on the main bracket and a locking element with a bracket locking surface with bracket teeth extending parallel to the rod teeth, the bracket portion further comprises a guide portion with two rod-receiving members having a first end mounted to the main bracket and extending therefrom, being spaced-apart from one another to define a lock-receiving cavity inbetween and being connected to one another at a second end, each one of the rod-receiving members having an aperture extending therethrough and defining a rod-receiving channel extending substantially parallel to the main bracket with the locking rod being insertable therein, the locking rod having a central longitudinal axis spaced-apart from the longitudinally-extending segment of the main bracket and being translatable in the rod-receiving channel in the released configuration of the arm restraint, the locking element being received in the lock-receiving cavity and biased towards the rod portion with the locking surfaces of the locking element and the locking rod extending substantially parallel to one another, being engaged together in the locked configuration to prevent relative displacement of the main bracket and the locking rod and being disengaged from one another in the released configuration to allow relative displacement of the main bracket and the locking rod, wherein the locking element translates perpendicularly to the locking rod between the locked configuration and the released configuration.

2. The lift as claimed in claim 1, wherein the main bracket defines a bracket locking end and a bracket pivoting end opposite the bracket locking end, the bracket pivoting end being pivotally mounted to the carriage and pivotable about a bracket pivot axis and the rod-receiving members extending from the main bracket adjacent to the bracket locking end.

3. The lift as claimed in claim 2, wherein the locking rod defines a rod pivoting end and a rod free end opposite the rod pivoting end, the rod pivoting end being pivotally mounted to the load-carrier arm so as to pivot about a rod pivot axis and wherein a section of the locking rod extends in the lock-receiving cavity.

4. The lift as claimed in claim 3, wherein the bracket portion of the locking assembly further comprises a biasing device operatively engaged with the locking element and biasing the bracket locking surface of the locking element towards the rod locking surface in the locked configuration of the arm restraint.

5. A method for lifting a vehicle with at two of the lift as claimed in claim 1, the method comprising:

positioning the vehicle between the at least two lifting posts of the at least two lifts, with the load-carrier arms being located in an arm restraint-disengaged section of the at least two lifting posts and therefore being pivotable with respect to the at least two lifting posts, with the arm restraints of the at least two lifting posts abutting at least one of the floor and a base of the at least two lifting posts;

positioning the load-carrier arms in a lifting configuration under the vehicle; and raising the load-carrier arms along the at least two lifting posts and above the arm restraint-disengaged section of the at least two lifting posts, thereby disengaging the arm restraints from the at least one of the floor and the base and automatically configuring the arm restraints in the locked configuration preventing pivoting of the load-carrier arms with respect to the at least two lifting posts.

6. An arm restraint in combination with a heavy load lift, the heavy load lift comprising a lifting post including a post structure extending upwardly, a carriage slidably mounted to the post structure, and a pivotable load-carrier arm mounted to the carriage and vertically displaceable therewith along the post structure, the arm restraint comprising:

a main bracket mounted to the carriage and vertically displaceable therewith along the post structure, the main bracket including a longitudinally-extending segment; and a locking rod mounted to the load-carrier arm and having a rod portion with a rod locking surface including rod teeth;

a locking assembly having a bracket portion provided on the main bracket and a locking element with a bracket locking surface including bracket teeth extending parallel to the rod teeth, the bracket portion further comprises a guide portion with two rod-receiving members having a first end mounted to the main bracket and extending therefrom, being spaced-apart from one another to define a lock-receiving cavity inbetween and being connected to one another at a second end, each one of the rod-receiving members having an aperture extending therethrough and defining a rod-receiving channel extending substantially parallel to the main bracket with the locking rod being insertable therein, the locking rod having a central longitudinal axis spaced-apart from the longitudinally-extending segment of the main bracket and being translatable in the rod-receiving channel in a released configuration of the arm restraint, the locking element being received in the lock-receiving cavity, the bracket locking surface and the rod locking surface extending substantially parallel to one another and being automatically disengaged from one another by translating the locking element away from and perpendicularly to the locking rod when the carriage is positioned in an arm restraint-disengaged section of the post structure, thereby allowing relative displacement of the main bracket and the locking rod and pivoting of the load-carrier arm; and the bracket locking surface and the rod locking surface being automatically engaged together by translating the locking element towards and perpendicularly to the locking rod when the carriage is located outside the arm restraint-disengaged section, thereby preventing relative displacement of the main bracket and the locking rod and pivoting of the load-carrier arm.

7. The arm restraint as claimed in claim 6, wherein the main bracket defines a bracket locking end and a bracket pivoting end opposite the bracket locking end, the bracket pivoting end being pivotally mounted to the carriage and pivotable about a bracket pivot axis and the rod-receiving members extending from the main bracket adjacent to the bracket locking end.

8. The arm restraint as claimed in claim 6, wherein the locking rod defines a rod pivoting end and a rod free end opposite the rod pivoting end, the rod pivoting end being pivotally mounted to the load-carrier arm so as to pivot about a rod pivot axis and wherein a section of the locking rod extends in the lock-receiving cavity.

9. The arm restraint as claimed in claim 8, wherein the bracket portion of the locking assembly further comprises a biasing device operatively engaged with the locking element and biasing the bracket locking surface of the locking element towards the rod locking surface when the carriage is located outside the arm restraint-disengaged section.

10. The arm restraint as claimed in claim 9, wherein the lifting post comprises a base supporting the lifting post on a floor and the main bracket comprises a lever abutting at least one of the floor and the base when the carriage is positioned in the arm restraint-disengaged section along the post structure to configure the arm restraint in the released configuration.

11. The arm restraint as claimed in claim 10, wherein the locking assembly further comprises a lock transmission assembly operatively coupling the locking element to the lever so as to allow the displacement of the locking element between an engaged configuration and a disengaged configuration in accordance with a configuration of the lever with the locking element being configured in the disengaged configuration when the lever is abutting at least one of the floor and the base.

12. The arm restraint as claimed in claim 11, wherein the lock transmission assembly comprises:

a transmission link extending between a first end and a second end, the first end being operatively coupled to the lever;

a locking portion connector coupled to the locking element and translating therewith between the engaged and disengaged configurations;

an articulated connection connecting the locking portion connector to the transmission link; and the biasing device operatively connected to the locking portion connector for biasing the locking element into the engaged configuration when the lever is substantially free of external pressure applied thereon.

13. The arm restraint as claimed in claim 12, wherein the lever defines a base-engageable end and a bracket-connecting end, opposite the base-engageable end, the bracket-connecting end being pivotally mounted to main bracket and pivotable about a lever pivot axis.

14. The arm restraint as claimed in claim 13, wherein the first end of the transmission link is pivotally mounted to the bracket-connecting end at a lever connection point spaced apart from the lever pivot axis.

15. The arm restraint as claimed in claim 12, wherein the main bracket further comprises an articulation plate support extending downwardly from a lower surface of the main bracket and the articulated connection comprises:

an articulation plate defining a first articulation axis, a second articulation axis and a third articulation axis, the second end of the transmission link being pivotally coupled to the articulation plate at the first articulation axis, the articulation plate being pivotally mounted and coupled to the articulation plate support and pivotable about the second articulation axis; and a connector link extending between a first link end and a second link end, the first link end being pivotally mounted and coupled to the articulation plate at the third articulation axis, the second link end being pivotally mounted and coupled to a lower end of the locking portion connector of the lock transmission assembly.

16. The arm restraint as claimed in claim 14, wherein the biasing device extends between the main bracket and the locking element when the lever is substantially free of external pressure applied thereon, the locking element is pushed towards the locking rod for engagement of the locking surfaces.

17. The arm restraint as claimed in claim 15, wherein the biasing device is a coiled spring surrounding a section of the locking portion connector.

18. The arm restraint as claimed in claim 12, wherein the locking portion connector extends through the main bracket into a connector channel extending therethrough and adjacent to the bracket locking end, the locking portion connector being translatably inserted in the connector channel with sections of the locking portion connector extending outwardly of the main bracket at both ends, the locking element being mounted to an upper end of the locking portion connector.

19. The arm restraint as claimed in claim 17, wherein a diameter of the connector channel is larger adjacent to the locking element to define a biasing device-receiving recess with a portion of the biasing device being inserted into the biasing device-receiving recess.

20. The arm restraint as claimed in claim 7, wherein the main bracket defines a bracket pivoting segment extending upwardly from the longitudinally-extending segment, wherein a distal end of the bracket pivoting segment is pivotally mounted to the carriage and pivotable about the bracket pivot axis.

* * * * *